United States Patent [19]

Windhager

[11] Patent Number: 4,821,418

[45] Date of Patent: Apr. 18, 1989

[54] BLADE HOLDER

[76] Inventor: Alfred Windhager, 352 Ellamar Rd., West Palm Beach, Fla. 33405

[21] Appl. No.: 671,514

[22] Filed: Nov. 15, 1984

[51] Int. Cl.[4] ..... B26B 1/00

[52] U.S. Cl. ..... 30/329

[58] Field of Search ..... 30/329, 336

[56] References Cited

U.S. PATENT DOCUMENTS

| | | | |
|---|---|---|---|
| 88,024 | 3/1869 | Ferren | 30/329 X |
| 712,385 | 10/1902 | Kampfe et al. | 30/336 X |
| 836,079 | 11/1906 | Barnett | 30/329 X |
| 1,392,122 | 9/1921 | Cruise | 30/336 |
| 1,405,529 | 2/1922 | McGee | 30/336 |
| 1,498,324 | 6/1924 | Langenbach | 30/336 |
| 3,665,605 | 5/1972 | Howerten | 30/334 X |
| 4,137,631 | 2/1979 | Pickett et al. | 30/329 X |
| 4,481,689 | 11/1984 | Westmoreland | 30/169 X |

FOREIGN PATENT DOCUMENTS

| | | | |
|---|---|---|---|
| 15749 | of 1908 | United Kingdom | 30/329 |
| 240284 | 10/1925 | United Kingdom | 30/329 |

*Primary Examiner*—Frank T. Yost
*Assistant Examiner*—Willmon Fridie, Jr.

[57] ABSTRACT

This invention comprises a blade holder comprising a handle, shaft and clamp whose clamp is made in the shape of a U-shaped channel of a width to receive and retain a two-edged blade, and whose shaft is bent at an angle sufficient to assure that the centerline of the handle does not align with the centerline of the portion of the shaft that is attached to the clamp. By this configuration, both edges of the two-edged blade can be used in positions in which those edges could not have been conveniently used.

1 Claim, 4 Drawing Sheets

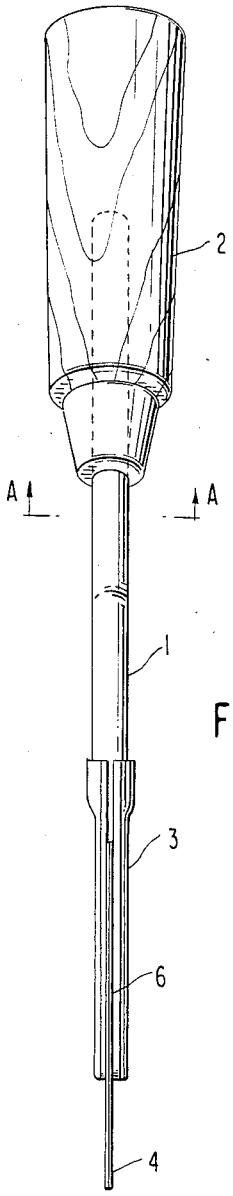
FIG. 1
FIG. 5
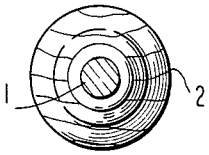
FIG. 6
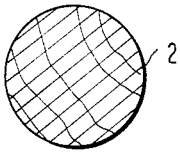
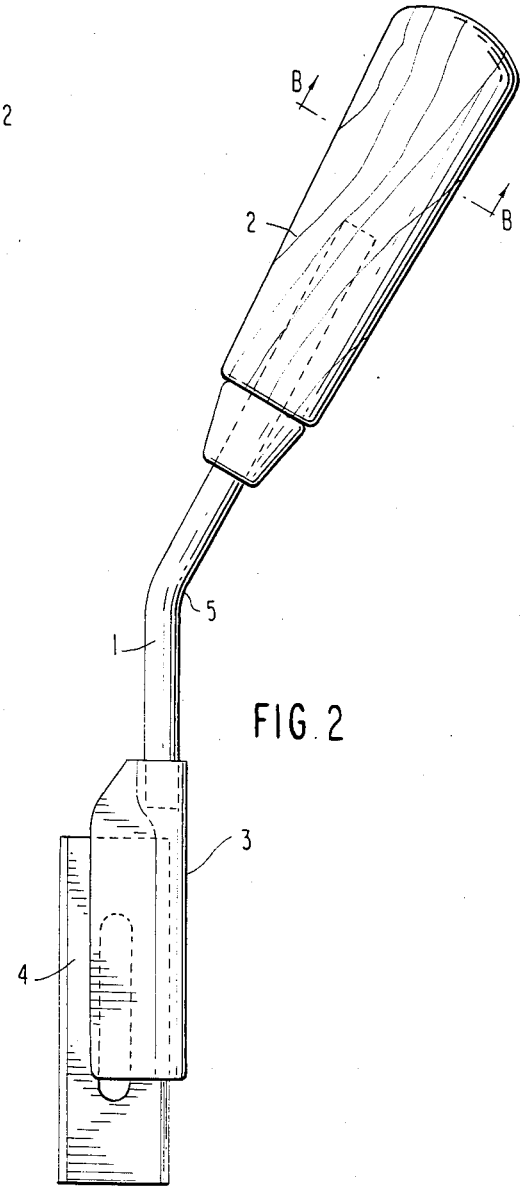
FIG. 2
FIG. 3
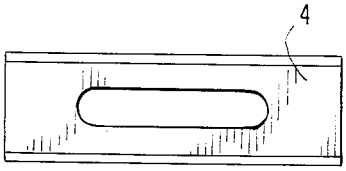
FIG. 4
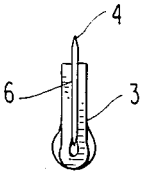

FIG. 7A
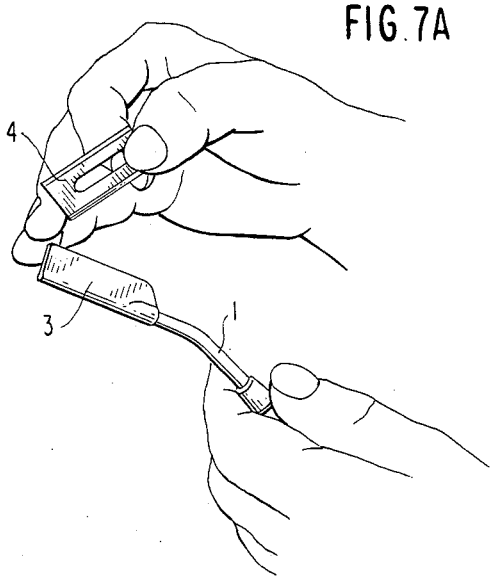
FIG. 7B
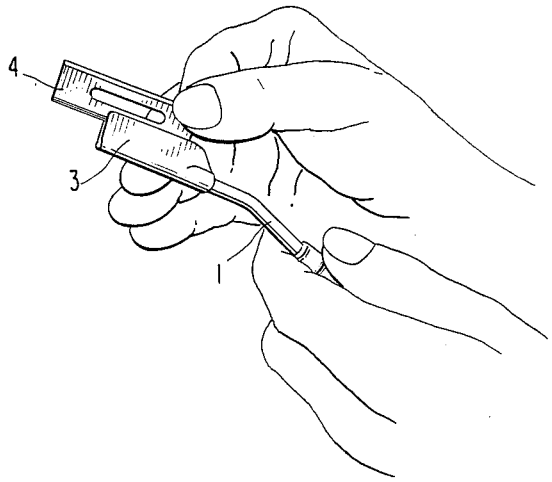
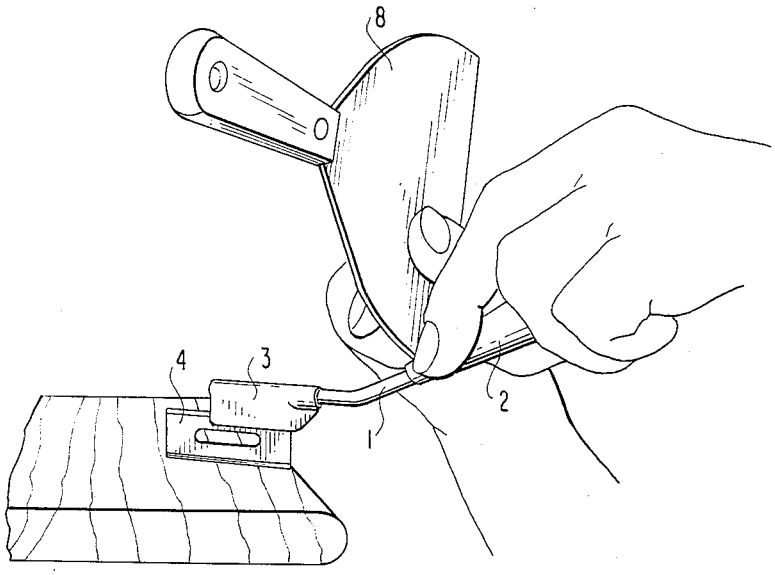
FIG. 7C
FIG. 7D
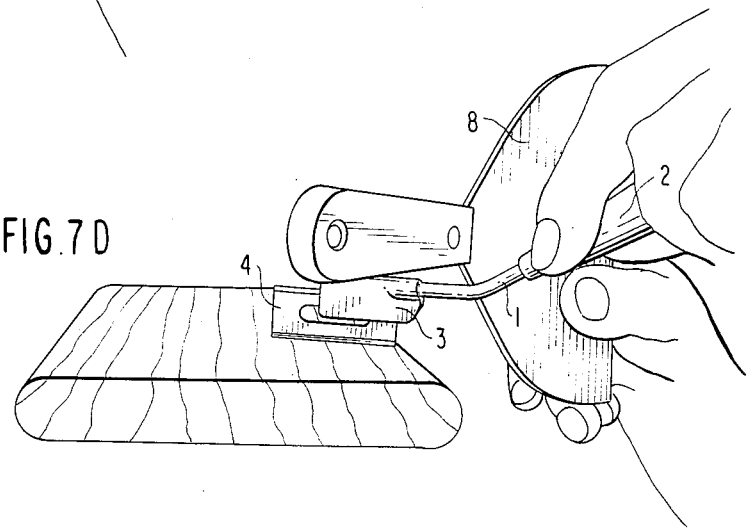

FIG. 7E
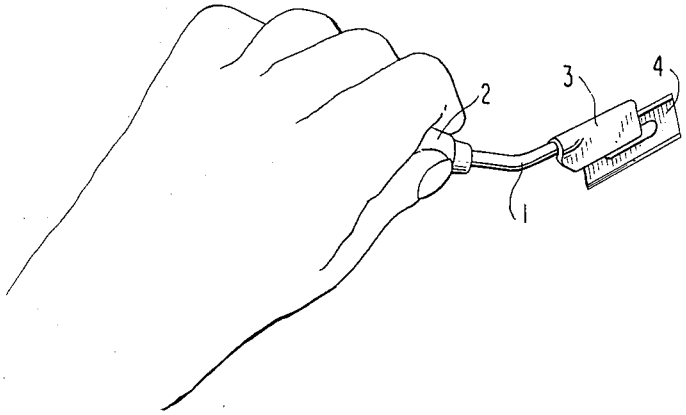
FIG. 7F
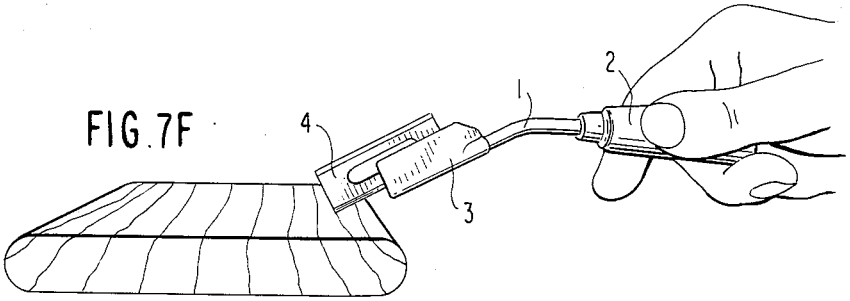
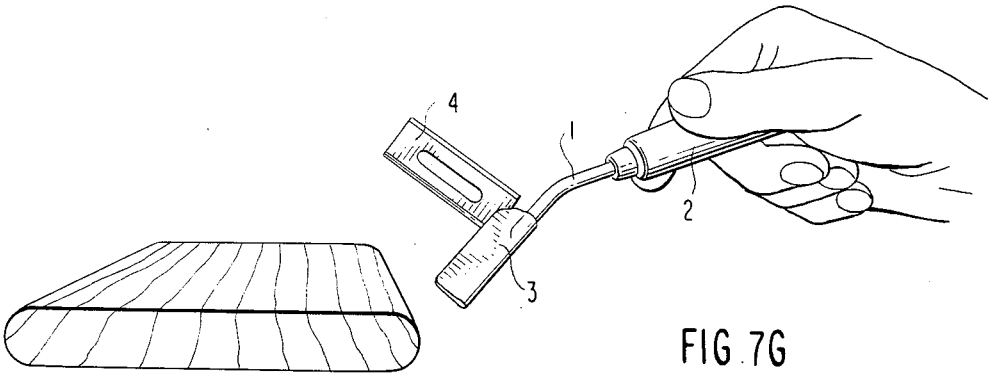
FIG. 7G

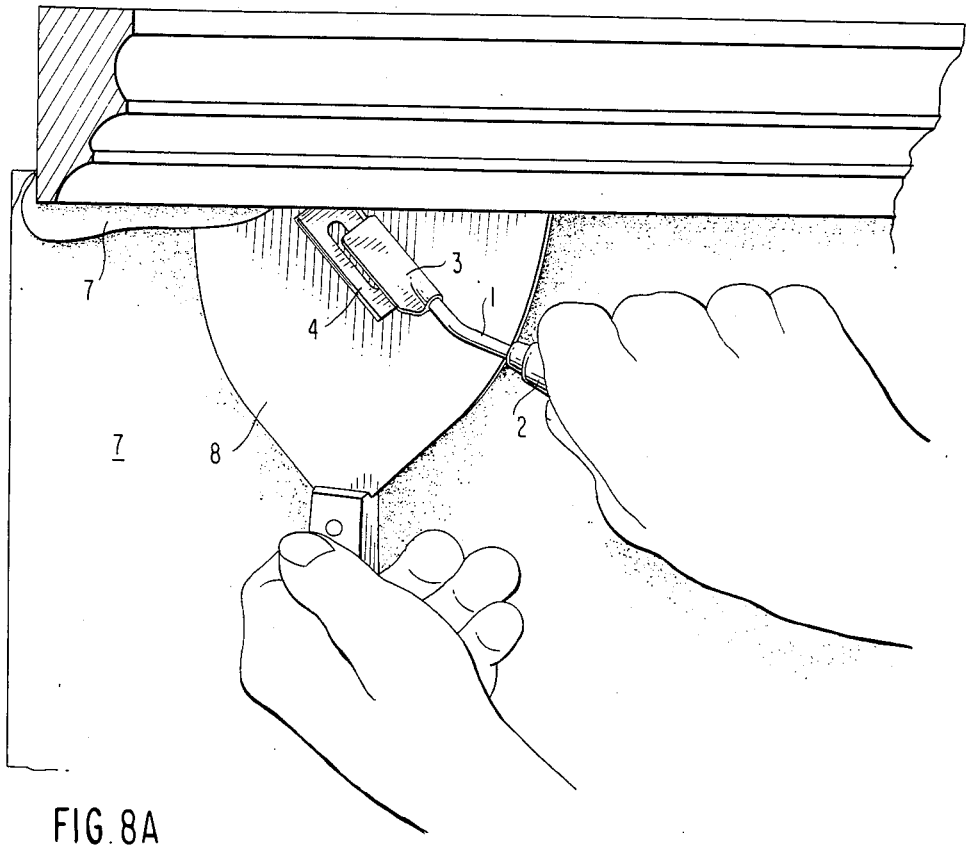
FIG. 8A
FIG. 8B
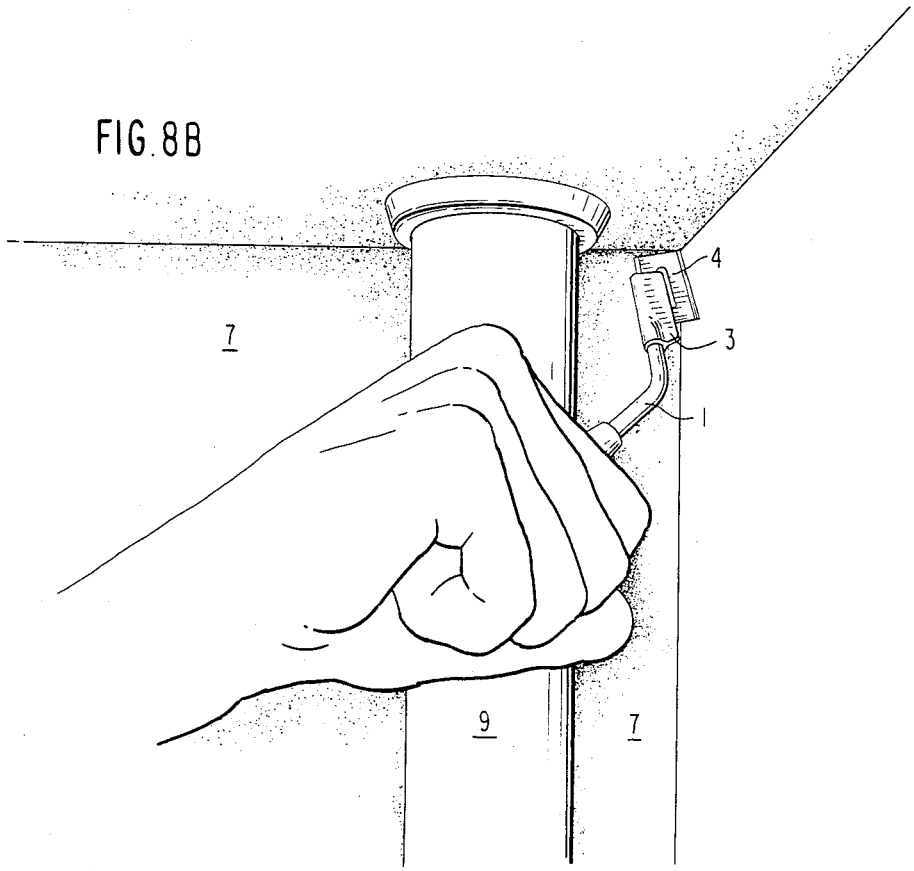

BLADE HOLDER

SUMMARY AND DETAILED DESCRIPTION

This invention comprises a blade holder made in a configuration that allows its efficient utilization in multiple positions when held in the hand of a workman. Those multiple positions of use are increased by the fact that both edges of a two-edge blade can be used efficiently when held by this blade holder.

U.S. Pat. No. 2,192,362 issued to Merlo in 1940 discloses a razor blade holder having a handle with a shaft connected to a substantially U-shaped holder in which a double edged blade is held by frictional engagement. However, the Merlo holder is hinged so that it would not be suitable for use in the upholstery, paper hanging or carpet laying trades. Also the Merlo holder is designed so that only one edge of the double edged blade is useful to the barber.

U.S. Pat. No. 2,267,934 issued to Lockett in 1941 also shows a razor blade holder that includes a pocket which holds a blade by frictional engagement. However, the Lockett holder does not provide the advantages of the present invention.

The present invention describes a sturdy blade holder that cannot be bent with human force.

The present blade holder provides an angle in its shaft that allows the hand of the workman holding the blade holder to grip the blade holder along its shaft while being provided with a multiplicity of cutting edges out of line with the centerline of the shaft.

The present blade holder provides a U-shaped blade clamp of sufficient shape and strength to allow the blade to be inserted easily, held firmly and removed easily.

These advantages are valuable savers of time to an upholsterer, paper hanger, carpet layer or other similarly skilled craftsman. Because of the efficiency and reliability of this configuration, the present blade holder is a valuable advance over the prior art.

FIG. 1 of the drawings that accompany this specification shows the present blade holder in a front elevational view.

FIG. 2 shows the present blade holder in a side elevational view.

FIG. 3 shows the front elevational view of a blade to be held in the present blade holder.

FIG. 4 shows a side elevational view of the U-shaped blade clamp of the present blade holder with a blade being held within that clamp.

FIG. 5 is a cross-sectional view of the present blade holder shown in plane A—A in FIG. 1.

FIG. 6 is a cross-sectional view of the handle of the present blade holder shown in plane B—B in FIG. 2.

FIGS. 7A–7G are side elevational views of the present blade holder that shows a wallpaper-carpet-upholsterer blade, or any similar trades blade inserted into and removed from the present blade holder.

FIGS. 8A and 8B are side elevational views of the present blade holder in use.

A detailed description of the present blade holder includes the following references to those figures of the drawings. The shaft 1 of the present blade holder is shown in both FIGS. 1 and 2 inserted into blade holder handle 2. Shaft 1 is shown in FIG. 2 inserted into blade clamp 3. Shaft and blade clamp can also be manufactured as one unit. Both shaft 1 and clamp 3 are made of a strong material such as steel. Handle 2 can be made of wood or plastic or the like.

The method of attachment of shaft 1 to clamp 3 is optional, but I have found that welding produces a satisfactory attachment. My preferred shaft 1 is made of ¼ inch round steel, although other sizes and materials could be used. Shaft 1 is bent at angle 5 to the degree of angle preferred by the user. Any degree of angle could be chosen, but I prefer approximately a 30 degree angle of bend. The shape of the bottom of the channel may vary, depending on the method of fabrication, so long as the inner sides of channel 6 are substantially parallel.

Clamp 3 must be manufactured or fabricated to provide a U-shaped channel 6 into which double-edged blade 4 is inserted. Blade 4 is shown in FIGS. 1, 2 and 3, and can be of any satisfactory dimensions. I prefer to use an ordinary blade that is readily available commercially and is approximately 0.017 inch in width. The width of blade 4 determines the width of the U-shaped channel 6 in clamp 3 into which the blade must fit. The width of that channel must be such that blade 4 can be inserted into it by mechanical pressure that will not break blade 4 or dull its edge. While blade 4 is in that channel, it must be held there by frictional engagement with the inner sides of that channel while in use. And, after use, blade 4 can be removed by mechanical pressure that will not break blade 4. I have found that a channel width of approximately 0.017 inches is satisfactory to accomplish those requirements when a blade 4 of that same approximate width is used.

To prepare the present blade holder for use, the user holds blade 4 in his hand as shown in FIG. 7A and aligns one of the edges of the blade 4 with the U-shaped channel 6 in clamp 3.

The user next inserts the aligned edge of blade 4 into the U-shaped channel 6 in clamp 3 and manually slides blade 4 into channel 6 as far as it can comfortably be inserted by manual pressure alone. FIG. 7B shows this step, and it should be noted that the user must be careful not to cut himself by blade 4 during this step.

After manual insertion of blade 4 as shown in FIG. 7B, the user rests the edge of blade 4 opposite the edge inserted into clamp 3 on a wooden or other suitable surface as shown in FIG. 7C and drives clamp 3 down around blade 4 with the handle of a hand-held scraper 8 or other suitable tool as shown in FIGS. 7C and D. During this step, clamp 3 should be driven into firm frictional engagement of blade 4 but not driven down so far as to dull the edge of blade 4 that has been inserted into clamp 3.

By following the steps shown in FIGS. 7A–7D, the present blade holder is prepared for use. FIG. 7E shows the blade holder ready for use held in the hand of a craftsman.

After the user has finished using the present blade holder, or when the user desires to change blade 4 for another blade, the exposed end of the edge of blade 4 that was inserted into clamp 3 can be rested on a wooden or other suitable surface as shown in FIG. 7F.

Next, by manual pressure against that wooden surface, blade 4 can be pivoted partly free from frictional engagement within the U-shaped channel 6 of clamp 3 as shown in FIG. 7G. If blade 4 resists pivoting by no more than manual pressure, the handle of a hand-held scraper 8 or other suitable tool can be used to drive the blade holder down and pivot blade 4 into its position shown in FIG. 7G.

Once blade 4 is partly free from frictional engagement within clamp 3, blade 4 can usually be removed by the hand of the user, being careful not to cut himself during such removal. If blade 4 resists manual removal from clamp 3 during this step, a pair of pliers or other suitable tool can be used to remove it without damaging blade 4.

FIG. 8A shows the present blade holder in use by a paperhanger. Handle 2 is gripped by the paperhanger's hand and one edge of blade 4 that is held in clamp 3 is used to trim the wallpaper 7 that is being held in position by scraper 8.

FIG. 8B shows the opposite cutting edge of blade 4 that is held in clamp 3 being used to trim wallpaper 7 in a corner that is partially obstructed by pipe 9. The positions of blade 4 and the hand of the paper-hanger in FIGS. 8A and 8B make clear the advantage the present blade holder affords the user to work in hard-to-reach places.

I claim:

1. A blade holder comprising a handle, a shaft attached to said handle and a clamp attached to said shaft, said shaft being bent to an angle sufficient to assure that the centerline of the portion of the shaft attached to said handle does not align with the centerline of the portion of the shaft that is attached to said clamp, and said clamp comprising a member that defines a channel whose sides are substantially parallel and whose width is approximately the same as the width of a two-edged blade to be held by said clamp, said clamp being made of a strong material so that the substantially parallel inner sides of the member securely grip and hold the two-edged blade by friction in a position that exposes both edges of the two-edged blade at the same time and allows cutting by either edge of said two-edged blade during use of the blade.

* * * * *